US007007337B2

(12) United States Patent
Finochiaro et al.

(10) Patent No.: US 7,007,337 B2
(45) Date of Patent: Mar. 7, 2006

(54) PAINT ROLLER ASSEMBLY

(75) Inventors: Kenneth C. Finochiaro, Lakeville, MN (US); Marie T. Finochiaro, Lakeville, MN (US)

(73) Assignee: Kenmar Manufacturing Co., Lakeville, MN (US)

( * ) Notice: Subject to any disclaimer, the term of this patent is extended or adjusted under 35 U.S.C. 154(b) by 0 days.

(21) Appl. No.: 10/924,678

(22) Filed: Aug. 24, 2004

(65) Prior Publication Data

US 2005/0091778 A1 May 5, 2005

Related U.S. Application Data

(60) Provisional application No. 60/497,881, filed on Aug. 25, 2003.

(51) Int. Cl.
*B05C 17/02* (2006.01)

(52) U.S. Cl. ..... 15/230.11; 492/13; 492/19

(58) Field of Classification Search ..... 15/230.11; 492/13, 19

See application file for complete search history.

(56) References Cited

U.S. PATENT DOCUMENTS 3,409,929 A 11/1968 Fisher ..... 15/248.2
6,219,877 B1 4/2001 Lowrey et al. ..... 15/230.11

FOREIGN PATENT DOCUMENTS

DE 2001176 * 7/1971
DE 3813939 * 11/1989
JP 9-271712 * 10/1997

* cited by examiner

*Primary Examiner*—Mark Spisich

(57) ABSTRACT

A paint roller assembly has a lower frame and an upper frame. A spring connection assembly connects the upper frame to the lower frame to permit the upper frame structure to pivot or flex with respect to the lower frame. The upper frame and the lower frame are each constructed and arranged to receive a cylindrical paint roller support for holding paint rollers. A handle member on the lower frame is used by the workperson to operate the paint roller assembly.

29 Claims, 8 Drawing Sheets

PAINT ROLLER ASSEMBLY

CROSS REFERENCE TO RELATED APPLICATION

This application claims the benefit of U.S. provisional application Ser. No. 60/497,881 filed Aug. 25, 2003.

FIELD OF THE INVENTION

This invention relates generally to a paint roller assembly. Particularly, the paint roller assembly has two or more aligned rollers wherein one of the rollers pivots or flexes with respect to an adjacent roller.

BACKGROUND OF THE INVENTION

Paint rollers along with brushes, pads and sprayers, are painting tools. Paint can typically be applied much faster with a roller than with a brush onto walls, ceilings, decks, trim boards and masonry. A paint roller is typically constructed of a frame onto which a cylindrical roller is mounted for rotation. The roller is typically formed of a core to which a napped material is attached. The type of paint utilized and the surface to be painted typically determines the type and length of nap material, i.e., synthetic, lamb's wool or mohair. The roller is dipped into a paint tray to saturate the nap of the roller and then utilized to paint the desired surface.

Standard paint rollers or pan type rollers are typically cylindrical in configuration and may range in length from several inches to over one foot, however, 7 and 9 inch rollers are typically utilized for painting walls and smaller, i.e., 3 inch rollers, may be used for painting trim. The standard rollers typically utilize a wire frame having a wire cage to hold the roller core or sleeve, to maintain its cylindrical shape and to permit the roller to smoothly rotate. Although paint rollers with single rollers have commonly been utilized by painters, multiple paint rollers have also been proposed for painting uses.

The benefit of using multiple rollers for painting purposes has been recognized. For example, multiple rollers have been used to provide various painting effects and to provide splatter resistant structures. Although multiple rollers have been proposed in the prior art, these rollers are typically constructed for specialized painting results, are complex in structure, have been difficult to manufacture, or have been difficult to use.

The paint roller assembly of the present invention provides an effective multi-roller painting device which overcomes the shortcomings and limitations of the prior art devices. The paint roller assembly of the invention provides an effective and efficient multiple roller assembly for painting which provides the advantage of quicker paint application, reducing the need of back rolling and providing a better paint finish.

SUMMARY OF THE INVENTION

A paint roller assembly having a frame structure comprised of a lower frame and an upper frame. The lower frame has a handle member. A spring connection is provided for connecting the lower frame to the upper frame. The spring connection permits the upper frame to pivot or flex with respect to the lower frame. The lower frame and the upper frame are constructed and arranged to receive a tubular roller comprised of a core with an exterior nap material. The rollers are vertically spaced and the spring connection permit the rollers to pivot or flex a predetermined distance, i.e., approximately 60 degrees in either direction.

The spring connection structure can be a two-part torsion spring or a single torsion spring having a predetermined flex strength which may be changed or modified depending upon painting conditions. In use, one spring may be operative in one pivot direction, while the second spring may be active in the opposite pivot direction. Alternatively, both springs may be in use where one spring may be in compression while the other is in tension depending upon the pivot direction. The spring length and spring material diameter may be altered to obtain the desired flex or torsional resistance strength.

The handle member may be provided with means to add an extension handle so that the painter may reach ceilings and high wall areas. For example, the handle member may have a female type threaded bore to receive a male type threaded end of a handle extension.

These and other benefits of this invention will become apparent from the following description by reference to the drawings.

DESCRIPTION OF THE PREFERRED EMBODIMENTS

Figure 1:
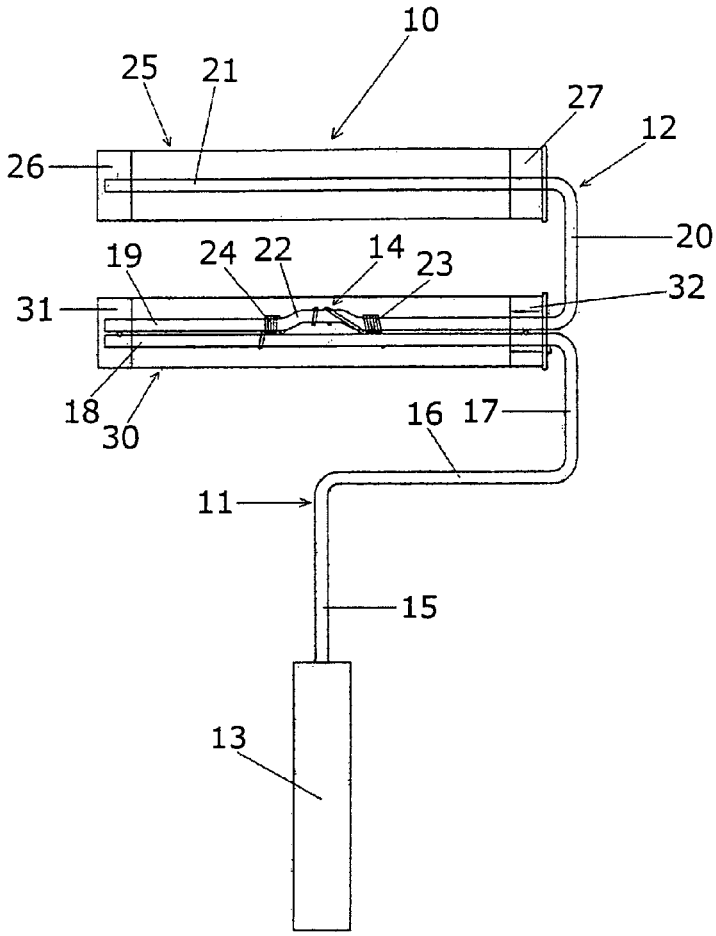
FIG. 1 is a plan view of the paint roller assembly of the present invention.
Figure 2:
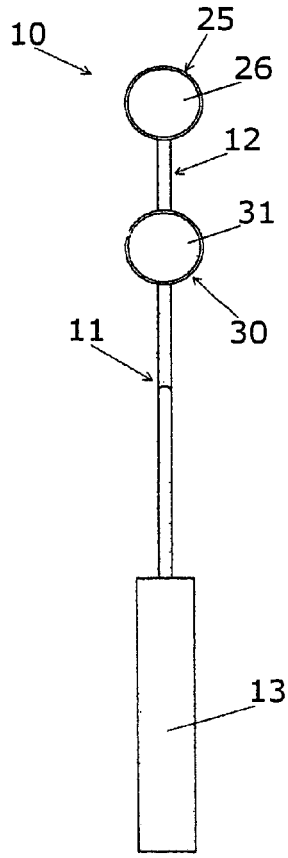
FIG. 2 is an end elevational view of the left end of the paint roller assembly of FIG. 1.

Referring to FIGS. 1 and 2 the paint roller assembly 10 of the present invention is shown. The roller assembly 10 has a lower frame 11 and an upper frame 12. The lower frame 11 is joined to the upper frame 12 by a connecting and flexing means 14. A handle member 13 is attached to the bottom of the lower frame 11. The lower frame 11 and the upper frame 12 have a lower roller support 30 and an upper roller support 25, respectively.

Figure 6:
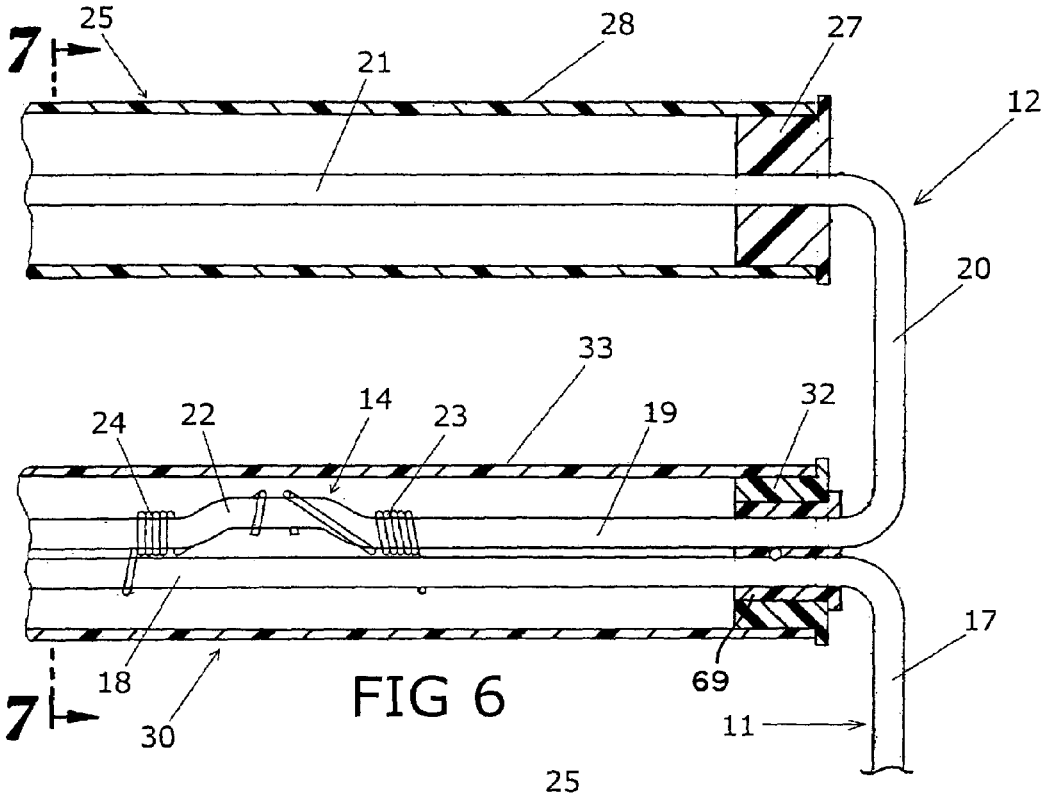
FIG. 6 is an enlarged sectional view showing the frame connecting and flexing structure of the paint roller assembly of FIG. 1.
Figure 7:
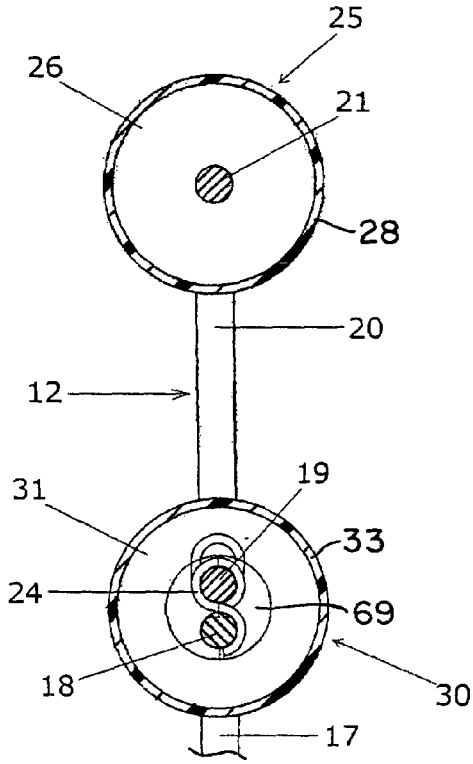
FIG. 7 is a sectional view taken along the line 7—7 of FIG. 6.

As further shown, the lower frame 11 is comprised of an elongated, formed rod element comprising lower portion 15, frame portion 16, frame portion 17 and frame portion 18 which is generally parallel to frame portion 16, while portions 15 and 17 are generally spatially parallel to each other. The upper frame portion 12 is shown comprised of a generally U-shaped rod structure comprising a lower connecting frame portion 19, having an armor raised rod portion 22, a frame portion 20 and a frame portion 21. The frames 11 and 12 are cylindrical metal rods or tubes having outside diameters of ¼ to ⅜ inches. Other sizes of rods can be used for frames 11 and 12. Rods 18 and 19 extend through holes in a plug 69 that rotatably supports end cap 32. A similar plug rotatably supports end cap 31. Retainers, such as C rings or E rings connect the plug to the ends of rods 18 and 19. The connection and flexing means 14 is shown comprised of torsion spring member 23 and torsion spring member 24 which are attached outward from the raised portion 22 of frame portion 19 and connecting to frame portion 18 of the lower frame 11. As shown in FIGS. 6 and 7, torsion coil spring 23 coils around rod 19 adjacent one side of rod portion 22. One end of spring 23 extends downward and engages rod 18. The other end of spring 23 hooks over rod portion 22 whereby spring 23 biasing or turns rod 19 in counter clockwise direction. Spring 24 coils around rod 19 adjacent the other side of rod portion 22. As shown in FIG. 7, the lower end of spring 24 hooks around rod 18. The upper end of spring 24 hooks over rod portion 22 whereby spring 24 biases or turns rod 19 in a clockwise direction. Springs 23 and 24 have substantially the same torsion forces whereby springs 23 and 24 maintain frame 12 vertically aligned or in a common plane with frame 11. Force exerted on handle 13 is required to angularly move frames 11 and 12 and roller supports 25 and 30 mounted on the frames.

Figure 18:
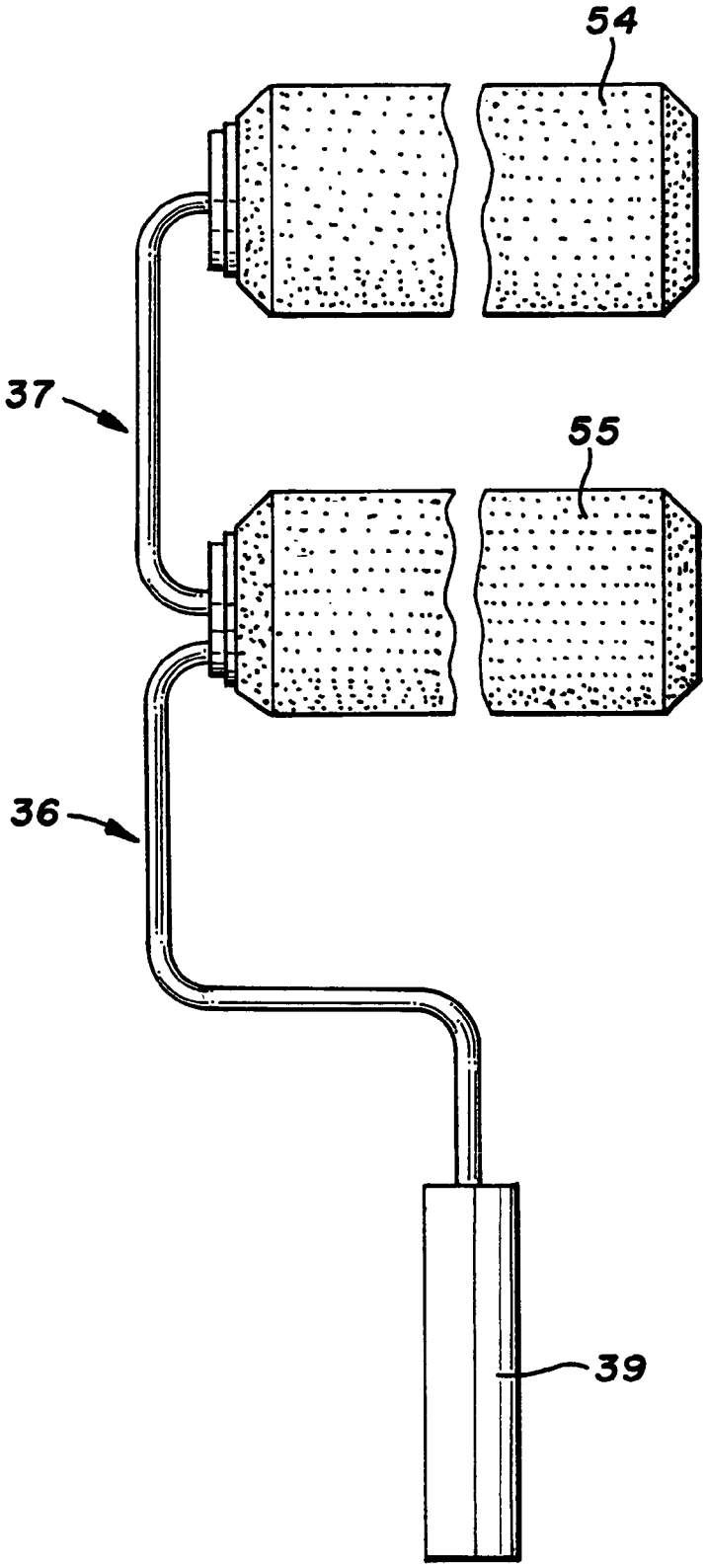
FIG. 18 is a foreshortened front elevational view of the paint roller assembly of the invention equipped with conventional cylindrical rollers.
Figure 19:
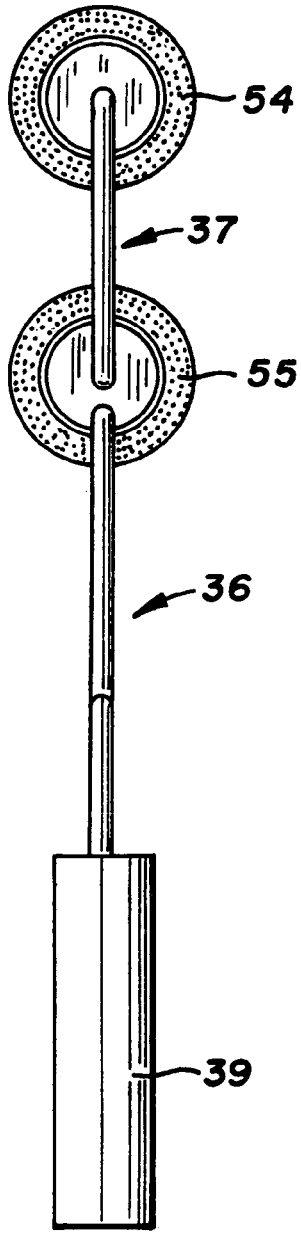
FIG. 19 is an end elevational view of the left end of the paint roller assembly of FIG. 18.

FIG. 1 further shows the upper roller support 25 comprising end caps 26 and 27 which rotates about frame portion 21 of the upper frame 12. Lower roller 30 is shown comprised of end caps 31 and 32 which rotate about frame portion 19 of the upper frame 12 and frame portion 18 of the lower frame 11. The upper and lower roller supports 25 and 30 are constructed and arranged to receive and hold the cores of the rollers used for painting as shown in FIGS. 18 to 20.

As shown particularly in FIG. 2, the upper roller support 25 is vertically aligned with the lower roller support 30 when in the stationary position. In this position the connecting and flexing means 14 holds the upper and lower roller supports vertically aligned with the handle member 13. The roller supports 25 and 30, frames 11 and 12, and handle member 13 are located in a common plane.

Figure 3:
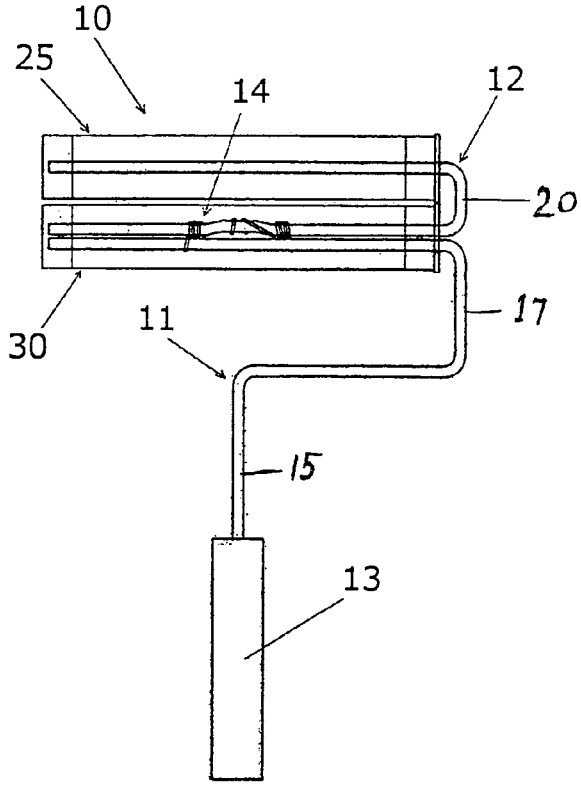
FIG. 3 is a plan view showing the paint roller assembly of FIG. 1 in a flexed position.
Figure 4:
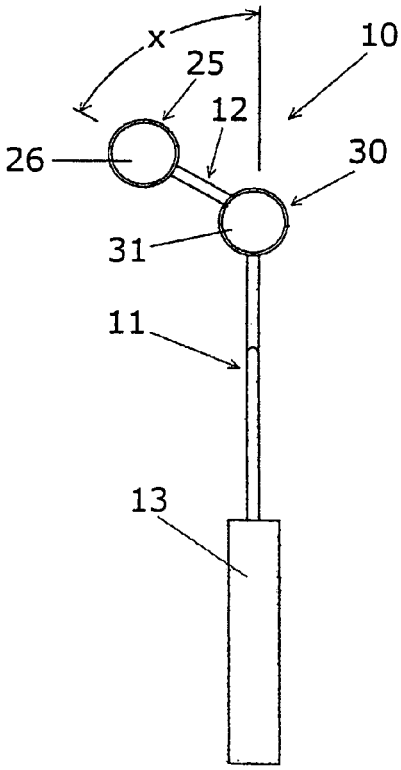
FIG. 4 is an end view showing the paint roller assembly of FIG. 1 in a first flexed position.
Figure 5:
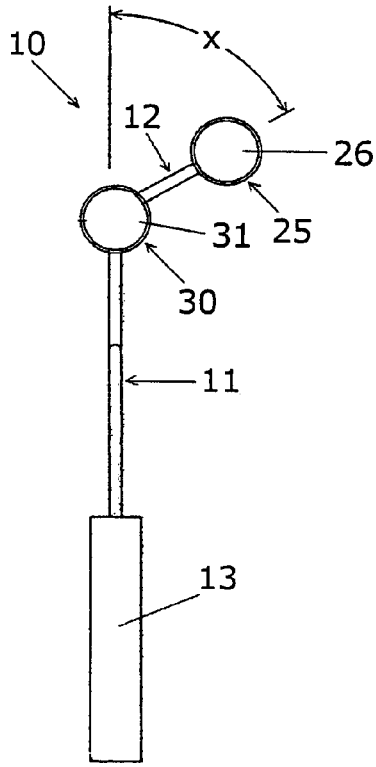
FIG. 5 is an end elevational view of the left end and the paint roller assembly of FIG. 4 in a second flexed position.

Referring further to FIGS. 3–5, the upper roller 25 is able to be flexed with respect to the lower roller 30. Specifically, FIG. 4 shows the upper roller support 25 flexed, i.e., at an angle "x", 60 degrees, in one direction, whereas, FIG. 5 shows the upper roller support 25 flexed at an angle "x", i.e., 60 degrees, in the opposite direction.

Figure 20:
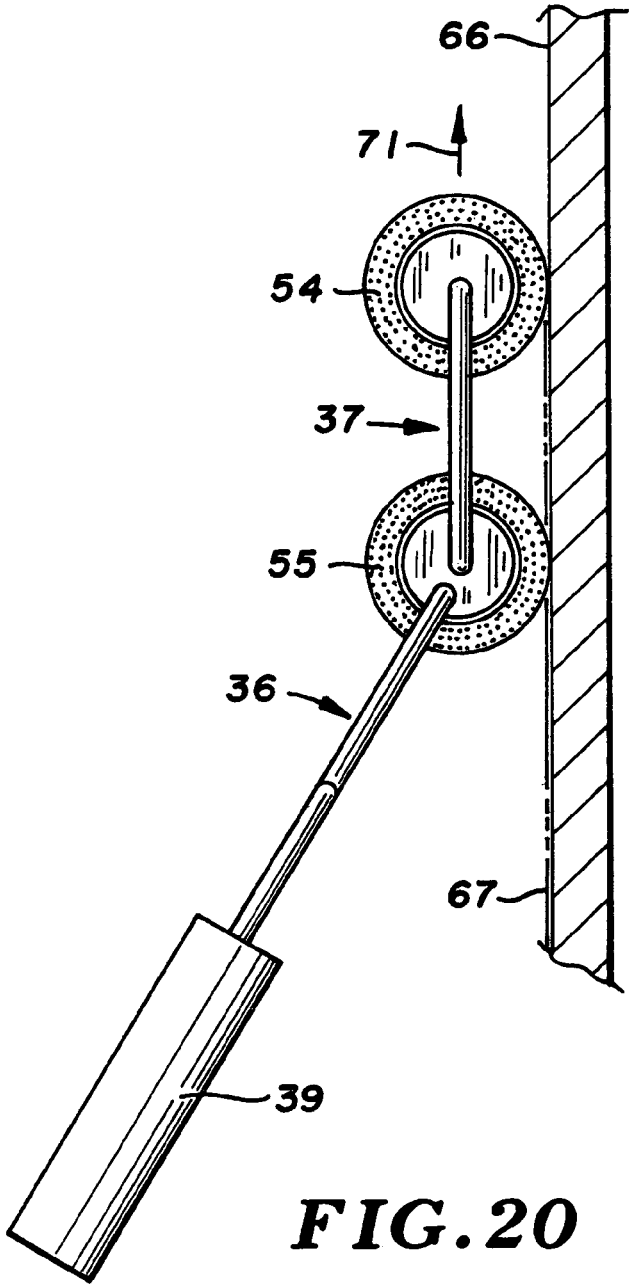
FIG. 20 is an end elevational view of the left end of the paint roller assembly of FIG. 8 operable to apply paint to a vertical surface.

In use, as show in FIG. 20, the upper roller 54 mounted on a roller support is utilized to pick up paint from a paint tray, for example. When the upper roller 54 is placed against the surface 66 to be painted, i.e., a wall or ceiling, for example, pressure on handle 39 will cause the upper frame 37 to flex with respect to lower frame 36 to thereby cause both rollers 54 and 55 to contact the surface 66 to apply a paint 67 to surface 66. Although the upper roller 54 initially holds the paint to be applied, the lower roller 55 picks up any drippings and is utilized to smooth out the applied paint from roller 54. It has been found that painting can be accomplished quicker with less dripping and result in a smoother and more uniform paint application.

Returning to FIGS. 6 and 7, the upper roller support 25 is shown to have a tubular support structure 28 and lower roller support 30 is shown to have a tubular support structure 33. The roller support structures 28 and 33 extend from the end caps 27 and 32, respectively, and provide a means to support the sleeves or cores of the paint rollers. Support structures 28 and 33 are cylindrical plastic tubes mounted on the end caps that enclose rods 18, 19 and 21 and torsion springs 23 and 24. The roller support structures may be wire cages, known in the art onto which the cores may be positioned.

Figure 13:
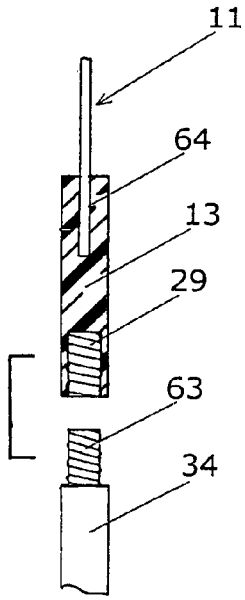
FIG. 13 is a plan view partially in section showing a handle member and a handle extension member.

FIG. 13 shows frame end portion 64 of lower frame 11 within handle member 13. Further, a handle extension member 34, such as a long pole, may be used in conjunction with the handle member 13. The handle member 13 may be constructed of a plastic, such as Delrin, or wood composition and may have a molded or formed grip portion if desired. The handle member 13 is shown to have an internally threaded end portion 29 for receiving the externally threaded post 63 of handle extension member 34, as is known in the art.

Figure 8:
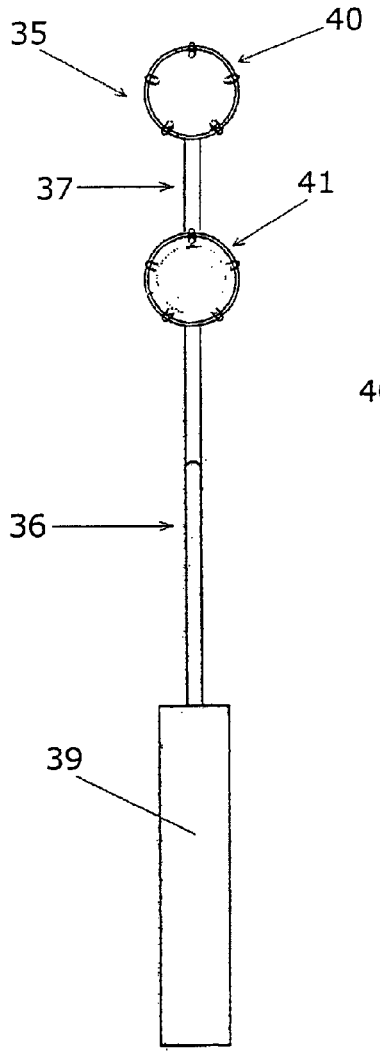
FIG. 8 is an end elevational view of another embodiment of the paint roller assembly of the invention.
Figure 9:
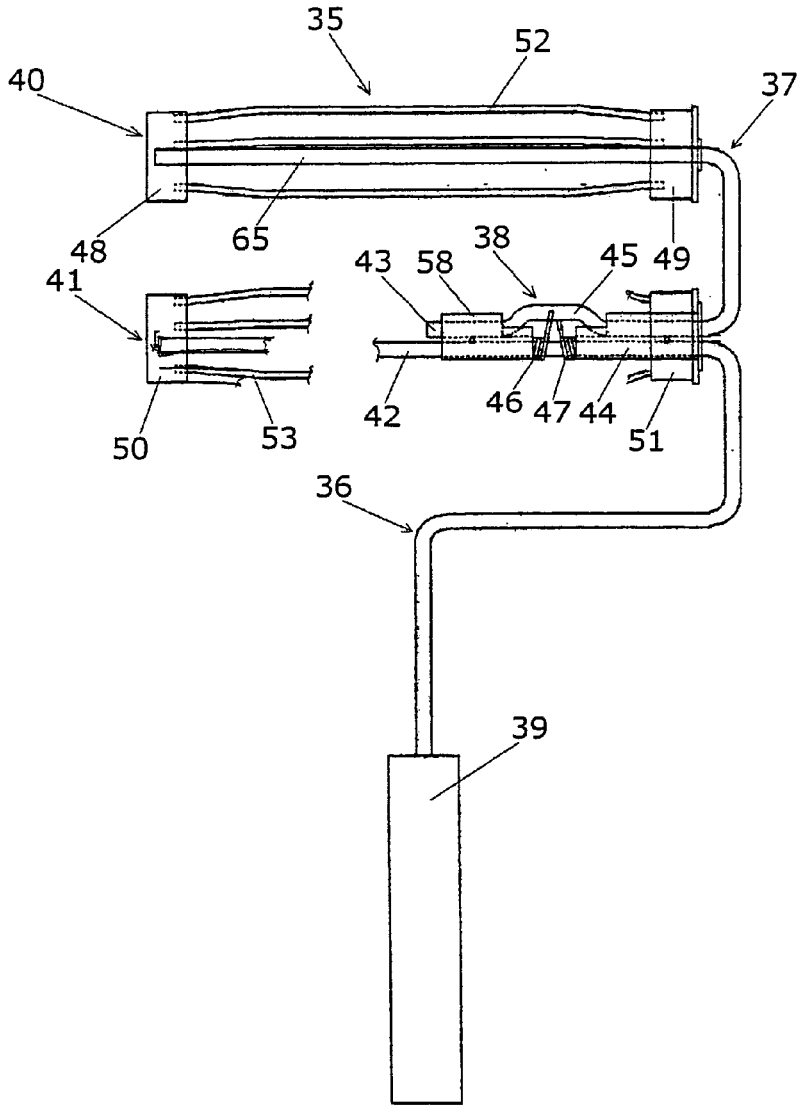
FIG. 9 is a foreshortened plan view of the paint roller assembly of FIG. 8.

Referring to FIGS. 8 and 9, another embodiment 35 of the paint roller assembly is shown. The roller assembly 35 is shown to have a lower frame 36 and an upper frame 37. A connection and flexing means 38 is shown joining the lower and upper frames 36 and 37. The lower frame 36 is further shown as connected to a handle member 39 and a lower roller support 41. The upper frame 37 is shown having an upper roller support 40.

The connection and flexing means between the lower frame and upper frame may comprise several and various structures. The key to the present invention is the connection between an upper frame 37 and a lower frame 36 and the flexing of the upper frame 37 with respect to the lower frame 36 as pressure is exerted against the upper roller during painting use. Although the use of a pair of rollers is discussed herein it is within the purview of the invention to utilize multiple rollers, i.e., two or more, whereby the upper rollers flex with respect to each other and with respect to the lower roller.

Referring particularly to FIG. 9, the upper frame 37 is shown to have an upper frame portion 65 and a lower connecting frame portion 43 with a raised portion 45. The lower frame 36 is shown having connecting portions 44 and 58. The connection and flexing means 38 is shown joining the lower frame portion 43 of the upper frame 37 and the upper frame portion 42 of the lower frame 36. Connecting members 44 and 58 are shown positioned on either side of the raised portion 45 and between which torsion spring members 46 and 47 are positioned. The spring members 46 and 47 have opposite biasing forces operable to maintain the upper and lower frames 37 and 36 in alignment and to provide a flexing rotational resistance force during the operation of the paint roller assembly.

The upper roller support 40, shown in FIG. 9, has end caps 48 and 49 and roller holders 52 extend between the end caps 48 and 49. For example, five such roller supports 52 comprise a plurality of elongated wire rods circumferentially spaced from each other and connected to end caps 48 and 49 or wire rods may be utilized. The roller support can be a cylindrical tubular member having opposite ends mounted on or connected to end caps 48 and 49. End caps 48 and 49 have aligned holes accommodating rod 65 whereby end caps 48 and 49 and roller support 52 rotate about the longitudinal axis of rod 65. A retainer, such as a C-ring or E-ring (not shown), holds end cap 48 on rod 65. The lower roller support 41 has end caps 50 and 51 and a plurality of roller supports 53 extended between end caps 50 and 51. The roller supports 53 form a wire cage onto which a paint roller is frictionally held as is known in the paint roller art. The roller support 53 can be a cylindrical tubular member having opposite ends mounted on or connected to end caps 50 and 51. However, in the present invention the lower roller support 41 has a connection and flexing means 38 within the space surrounded by the roller support 53 permits the upper roller 54 to flex or pivot with respect to the lower roller 55 according to the teachings of the present invention, as shown in FIG. 20.

Figure 10:
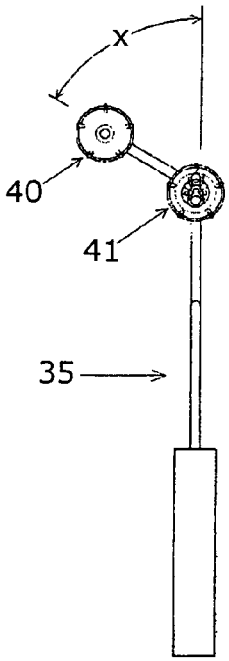
FIG. 10 is an end elevational view showing the paint roller assembly of FIG. 8 in a first flexed position.
Figure 11:
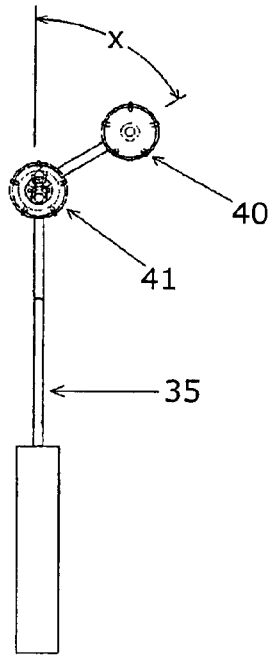
FIG. 11 is an end elevational view showing the paint roller assembly of FIG. 10 in a second flexed position.
Figure 12:
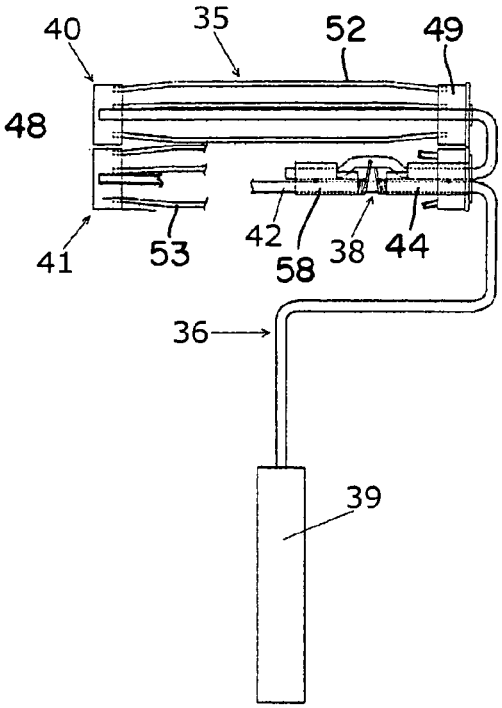
FIG. 12 is a plan view showing the paint roller assembly of FIG. 8 in a flexed position.

Referring to FIGS. 10–12, the paint roller assembly 35 is shown pivoted at an angle "x", whereby the upper roller support 40 is pivoted or flexed up to 60 degrees, for example, with respect to lower roller support 41. The connection and flexing means 38 permits the roller support 40 to angularly move during use of the paint roller assembly.

Figure 14:
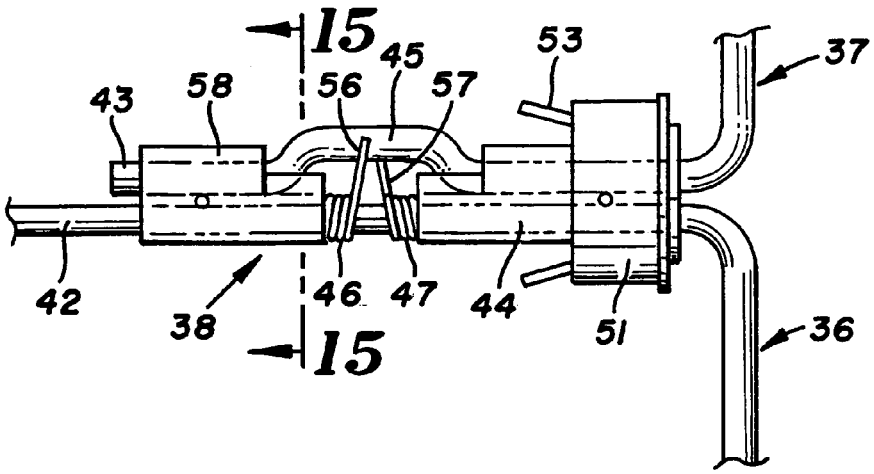
FIG. 14 is an enlarged front elevational view of the pivot connection of the frames and torsion biasing springs of the paint roller assembly of FIG. 8.
Figure 15:
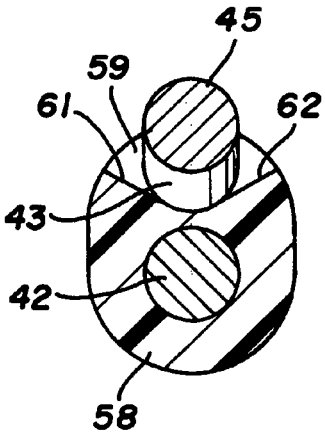
FIG. 15 is an enlarged sectional view taken along the line 15—15 of FIG. 14.
Figure 16:
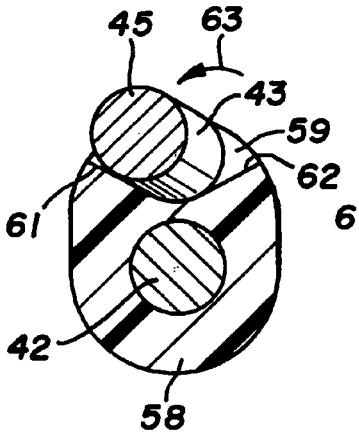
FIG. 16 is a sectional view similar to FIG. 15 showing the second frame member in the first flexed position.
Figure 17:
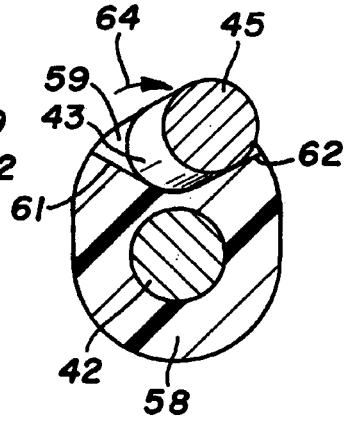
FIG. 17 is a sectional view similar to FIG. 15 showing the second frame member in the second flexed position.

The connection 38 between frames 36 and 37, shown in FIG. 14, has a first member 44 extended through end cap 51. Member 44 has a longitudinal hole accommodating rod 42 of frame 36 and V-shaped groove for rod 43 of frame 37. End cap 51 is rotatably mounted on member 44. Rod 43 has an off-set or raised section 45 located generally parallel to rod 42. The terminal end of rod 43 is rotatably supported on a second member 58. Rod 43 extends through a hole in member 58. Rod 42 extends through a second hole in member 58. Members 44 and 58 are fixed to rod 42 with pins, keys or other connecting devices. Of-set section 45 of rod 43 is a arm that is retained with torsion coil springs 46 and 47 in a central location between shoulders or stop surfaces 61 and 62 on member 58 as shown in FIG. 15. Member 44 also has stop surfaces similar to surfaces 61 and 62 for limiting the angular or pivotal movement of off-set section 45. AS shown in FIG. 16, off-set section 45 has been pivoted in a counter clockwise direction, shown by arrow 63, into engagement with shoulder 62. Pivoting the off-set section 45 in a clockwise direction, shown by arrow 64 in FIG. 17, move off-set section into engagement with shoulder 62. Shoulders 61 and 62 limit the angular movement of frame 37 and roller mounted thereon. As shown in FIGS. 10 and 11, the extent of the angular movement is shown by the arc X counter clockwise and the arc X clockwise.

Torsion coil springs 46 and 47 are biasing devices acting on the off-set section 45 of rod 43 to maintain frames 36 and 37 and rollers mounted thereon in general linear alignment as shown in FIGS. 8 and 19. First spring 46 has a coil body located around rod 42. One end of spring 46 is anchored in or retained by member 58. The opposite end 56 of spring 46 extends upwardly into engagement with one side of off-set section 45 and biases off-set section in a clockwise direction. Second torsion coil spring 47 has a coil body located around rod 42 adjacent member 44. One end of spring 47 is anchored on or retained by member 44. The opposite end 57 of spring 47 extends upwardly into engagement with a side of the off-set section opposite the one side of off-set section 45 and biases the off-set section 45 in a counter clockwise direction. Spring ends 56 and 57 are in biasing engagement with opposite sides of off-set section 45, the torsional biasing forces of springs 46 and 47 are substantially the same whereby the springs 46 and 47 maintain off-section 45 in a central location as shown in FIG. 15. When roller 54 is placed into contact with a fixed surface and external force of the hand of a user is applied to handle 39, the lower roller 55 is moved into engagement with the surface. Frame 36 and 37 pivot relative to each other. Handle 39 is located at an angle away from wall surface 66 whereby the workperson can readily move both rollers 54 and 55 upward, shown by arrow 71. The biasing force of one of the torsion coil springs and the off-set section 45 of rod 43 in engagement with stop surfaces of members 44 and 58 allows the workperson to vary the amount of contact pressure of rollers 54 and 55 on surface 66.

Paint roller assemblies are typically constructed in the USA to utilize 9 inch long rollers. However, other size roller structures are also utilized in the marketplace and metric sizes are utilized in Europe and other parts of the world. It is within the purview of the present invention to utilize 3, 4, 12 inch as well as rollers having other dimensions, for example. The advantage provided by the present invention are paint rollers having an upper roller which flexes with respect to a bottom roller.

With respect to a standard 9 inch roller assembly wherein the paint roller assembly 10 utilizes an upper roller 54 and a lower roller 55, as shown in FIG. 18, having a length of approximately 9 inches, the following dimensions have been found suitable: a handle member 39 length of approximately 5⅝ inches, a lower frame 36 with a lower portion length of approximately 3¾ inches, a frame 37 length of approximately 3⅛ inches and rod 42 length of approximately 9 inches. The cooperating upper frame structure 37 dimensions are rod 65 length of approximately 9 inches, side frame portion length of approximately 3⅛ inches and frame portion 43 length of approximately 4 inches.

As particularly shown in FIG. 9, the upper roller support 52 is connected to an end cap 48 which may have a diameter of approximately 1 7/16 inches and an internal center aperture of approximately ¼ inch to receive the end of rod 65 of upper frame 37. Frame 37 is a U-shaped metal rod having a diameter of approximately ¼ inch. The lower roller support 53 is connected to end cap 50. Cap 50 has an internal aperture of approximately ¾ inch, accommodating the end of rod 42.

Although the upper roller support and lower roller support are shown comprised of various elements to provide the ability of a paint roller to be frictionally mounted thereon, other structures to mount paint rollers on the frames may be utilized within the purview of the present invention. The important aspect of the invention being the flexing and biasing connection structure between a lower frame and an upper frame.

While particular embodiments of the paint roller assembly have been illustrated and described, it will be apparent to persons skilled in the art that various modifications, change of materials, arrangement of parts and shapes of the parts of the paint roller assembly can be made without departing from the scope of invention. The roller assembly has been described as used to apply paint to a surface. The roller assembly can be used to apply and spread other liquids and semi-liquids, such as cleaners, disinfectants, water, sizing, waxes, wood stains, varnishes, epoxy, and urethane finishes to floors, walls and other surfaces.

What is claimed is:

1. A paint roller assembly comprising: a first frame, a first paint roller support for holding a first paint roller rotatably mounted on the first frame, a handle connected to the first frame, a second frame comprising a U-shaped member having a first portion and a second portion located generally parallel to the first portion, a second paint roller support for holding a second paint roller rotatably mounted on the first portion of the second frame, and means connecting the first frame to the second frame being engageable with the second portion to allow rotation of the second portion relative to the first frame for allowing the second frame to angularly move relative to the first frame.

2. The paint roller assembly of claim 1 wherein: the first frame has a transverse portion and a longitudinal portion, said first paint roller support being rotatably mounted on the transverse portion and said handle being mounted on said longitudinal portion.

3. The paint roller of claim 1 wherein: the U-shaped member is a U-shaped metal rod.

4. The paint roller of claim 1 wherein: the means connecting the first frame to the second frame includes biasing means for retaining the first and second frames in a generally common plane.

5. A paint roller assembly comprising: a first frame, a first paint roller support for holding a first paint roller rotatably mounted on the first frame, a handle connected to the first frame, a second frame, a second paint roller support for holding a second paint roller rotatably mounted on the second frame, and means connecting the first frame to the second frame for allowing the second frame to angularly move relative to the first frame, said first frame includes a first rod, the second frame includes a second rod located adjacent and generally parallel to the first rod, said means connecting the first frame to the second frame including biasing means operatively engageable with the first and second rods to retain the first and second frames in a generally common plane.

6. The paint roller assembly of claim 5 wherein: the biasing means comprises torsion coil spring means located around the first rod and engageable with the second rod for retaining the first and second frames in said generally common plane.

7. The paint roller assembly of claim 6 wherein: the second rod has an off-set section laterally spaced from the first rod, a pair of members mounted on the first rod adjacent the off-set section, said torsion coil spring means being located between said pair of members, said torsion coil spring means having end portions engageable with said off-set section to apply opposite torsion forces to said off-set section.

8. The paint roller assembly of claim 7 wherein: at least one member has stop portions that are engaged by the off-set section to limit rotation of the second rod and angular movement of the second frame relative to the first frame.

9. The paint roller assembly of claim 7 wherein: each member has stop portions that are engaged by the off-set section to limit rotation of the second rod and angular movement of the second frame relative to the first frame.

10. The paint roller assembly of claim 5 wherein: the biasing means comprises torsion coil spring means mounted on the second rod and engageable with the first rod operable to apply biasing forces on the second rod to retain the first and second frames in said generally common plane.

11. The paint roller assembly of claim 10 wherein: the second rod has an off-set section laterally spaced from the first rod, said torsion coil spring means having end portions engageable with said off-set section to apply opposite torsion forces to said off-set section.

12. The paint roller assembly of claim 6 wherein: the second rod has an off-set section laterally spaced from the first rod, said torsion coil spring means having end portions engageable with said off-set section to apply opposite torsion forces to said off-set section.

13. The paint roller assembly of claim 12 including: at least one member mounted on the first rod rotatably supporting the second rod.

14. The paint roller assembly of claim 13 wherein: said member has shoulders that limit rotation of the second rod and angular movement of the second frame relative to the first frame.

15. A paint roller assembly comprising: a first frame having a first rod, a handle connected to the first frame, a second frame having a second rod located adjacent and generally parallel to the first rod and a third rod laterally spaced and generally parallel to the second rod, a first roller support surrounding the first and second rods for holding a first paint roller, end caps connected to the first roller support, means rotatably mounting the end caps on at least one of the first and second rods, a second roller support surrounding the third rod for holding a second paint roller, means rotatably mounting the second roller support on the third rod, and biasing means operatively connected to the first and second rods for retaining the first and second frames in a generally common plane, said biasing means allowing the first frame to pivot relative to the second frame when external force is applied to the handle.

16. The paint roller assembly of claim 15 wherein: the second frame is a U-shaped member having the second and third rods.

17. The paint roller assembly of claim 15 wherein: the first roller support is a cylindrical tubular member mounted on the end caps.

18. The paint roller assembly of claim 15 wherein: the second roller support is a cylindrical tubular member.

19. The paint roller assembly of claim 15 wherein: the biasing means comprises torsion coil spring means located around the first rod and engageable with the second rod to retain the first and second frames in said generally common plane.

20. The paint roller assembly of claim 19 wherein: the second rod has an off-set section laterally spaced from the first rod, said torsion coil spring means having end portions engageable with said off-set section to apply opposite torsion forces to said off-set section.

21. The paint roller assembly of claim 20 including: at least one member mounted on the first rod rotatably supporting the second rod.

22. The paint roller assembly of claim 21 wherein: said member has shoulders that limit rotation of the second rod and angular movement of the second frame relative to the first frame.

23. The paint roller assembly of claim 20 including: a pair of members mounted on the first rod rotatably supporting the second rod.

24. The paint roller assembly of claim 23 wherein: each member has shoulders that limit rotation of the second rod and angular movement of the second frame relative to the first frame.

25. The paint roller assembly of claim 15 wherein: said biasing means comprises a torsion coil spring, the second rod has an off-set section laterally has an off-set section laterally spaced from the first rod, a pair of members mounted on the first rod adjacent the off-set section, said torsion coil spring being located between said pair of members, said torsion coil spring having end portions engageable with said off-set section to apply opposite torsion forces to said off-set section.

26. The paint roller assembly of claim 25 wherein: at least one member has stop portions that are engaged by the off-set section to limit rotation of the second rod and angular movement of the second frame relative to the first frame.

27. The paint roller assembly of claim 25 wherein: each member has stop portions that are engaged by the off-set section to limit rotation of the second rod and angular movement of the second frame relative to the first frame.

28. The paint roller assembly of claim 15 wherein: the biasing means comprises torsion coil spring means mounted on the second rod and engageable with the first rod operable to apply biasing forces on the second rod to retain the first and second frames in said generally common plane.

29. The paint roller assembly of claim 28 wherein: the second rod has an off-set section laterally spaced from the first rod, said torsion coil spring means having end portions engageable with said off-set section to apply opposite torsion forces to said off-set section.

* * * * *